US011713917B2

(12) United States Patent
De Albuquerque et al.

(10) Patent No.: US 11,713,917 B2
(45) Date of Patent: Aug. 1, 2023

(54) REFRIGERATOR APPLIANCE WITH SELF-ADJUSTING MULLION

(71) Applicant: WHIRLPOOL CORPORATION, Benton Harbor, MI (US)

(72) Inventors: Alexandre Oliveira De Albuquerque, Joinville (BR); Rafael Sottili Chaves, Joinville (BR); Adalberto Matias Beppler, Jr., Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 138 days.

(21) Appl. No.: 17/351,891

(22) Filed: Jun. 18, 2021

(65) Prior Publication Data

US 2022/0404090 A1 Dec. 22, 2022

(51) Int. Cl.

| | |
|---|---|
| ***F25D 23/06*** | (2006.01) |
| ***F25D 11/02*** | (2006.01) |
| ***F25D 25/02*** | (2006.01) |

(52) U.S. Cl.

CPC ..... *F25D 23/069* (2013.01); *F25D 11/02* (2013.01); *F25D 25/024* (2013.01); *F25D 2325/021* (2013.01); *F25D 2400/04* (2013.01); *F25D 2400/16* (2013.01)

(58) Field of Classification Search

CPC ..... F25D 23/069; F25D 11/02; F25D 2400/04
See application file for complete search history.

(56) References Cited

U.S. PATENT DOCUMENTS

| | | | | |
|---|---|---|---|---|
| 4,217,010 | A | 8/1980 | Webb | |
| 8,529,001 | B2 * | 9/2013 | Calvillo | F25D 25/02 312/408 |
| 10,094,610 | B2 | 10/2018 | Sexton et al. | |
| 10,451,336 | B2 * | 10/2019 | Ribeiro | F25D 23/025 |

FOREIGN PATENT DOCUMENTS

| | | | |
|---|---|---|---|
| CN | 108917276 | A | 11/2018 |
| CN | 111174510 | A | 5/2020 |

* cited by examiner

*Primary Examiner* — Lionel Nouketcha
(74) *Attorney, Agent, or Firm* — Brooks Kushman P.C.

(57) ABSTRACT

A refrigerator appliance includes a housing, a mullion, and a biasing element. The housing defines an internal cavity and door frame that accesses the internal cavity. The mullion is disposed within the cavity and divides the cavity into a freezer compartment and a refrigerator compartment. A position of the mullion is adjustable within the cavity such that movement of the mullion away from the freezer compartment and toward the refrigerator compartment increases a volume of the freezer compartment and decreases a volume of the refrigerator compartment, and such that movement of the mullion away from the refrigerator compartment and toward the freezer the compartment decreases the volume of the freezer compartment and increases the volume of the refrigerator compartment. The biasing element is secured to the housing and the mullion. The biasing element is configured to bias the mullion toward the freezer compartment.

20 Claims, 4 Drawing Sheets

REFRIGERATOR APPLIANCE WITH SELF-ADJUSTING MULLION

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a plurality of walls, a door, a mullion, and at least one biasing element. The plurality of walls defines an internal cavity and an opening to the internal cavity. The door is rotatably secured to at least one of the walls and is disposed over the opening. The mullion is disposed within the cavity. The mullion is vertically slidable along the walls within the cavity. The mullion divides the cavity into a freezer compartment and a refrigerator compartment. Lowering a position of the mullion increases a volume of the freezer compartment and decreases a volume of the refrigerator compartment. Raising the position of the mullion decreases the volume of the freezer compartment and increases the volume of the refrigerator compartment. The at least one biasing element is secured to the mullion and at least one of the walls. The at least one biasing element is configured to bias the mullion upward. Placement of food items on the mullion lowers the position of the mullion and removal of food items from the mullion raises the position of the mullion.

A refrigerator appliance includes a housing, a shelf, and a biasing element. The housing defines a first compartment, a second compartment, and an opening. The opening accesses both the first and second compartments. The shelf is disposed within the housing. The shelf separates the first compartment from the second compartment. The shelf is slidable relative to the housing such that movement of the shelf in a first direction increases a volume of the first compartment and decreases a volume of the second compartment, and such that movement of the shelf in a second direction decreases the volume of the first compartment and increases the volume of the second compartment. The biasing element is configured to bias the shelf toward the second direction. Placement of items on the shelf adjusts a position of the shelf toward the first direction and removal of items from the shelf adjusts the position of the shelf toward the second direction.

A refrigerator appliance includes a housing, a mullion, and a biasing element. The housing defines an internal cavity and a door frame that accesses the internal cavity. The mullion is disposed within the cavity and divides the cavity into a freezer compartment and a refrigerator compartment. A position of the mullion is adjustable within the cavity such that movement of the mullion away from the freezer compartment and toward the refrigerator compartment increases a volume of the freezer compartment and decreases a volume of the refrigerator compartment, and such that movement of the mullion away from the refrigerator compartment and toward the freezer the compartment decreases the volume of the freezer compartment and increases the volume of the refrigerator compartment. The biasing element is secured to the housing and the mullion. The biasing element is configured to bias the mullion toward the freezer compartment.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
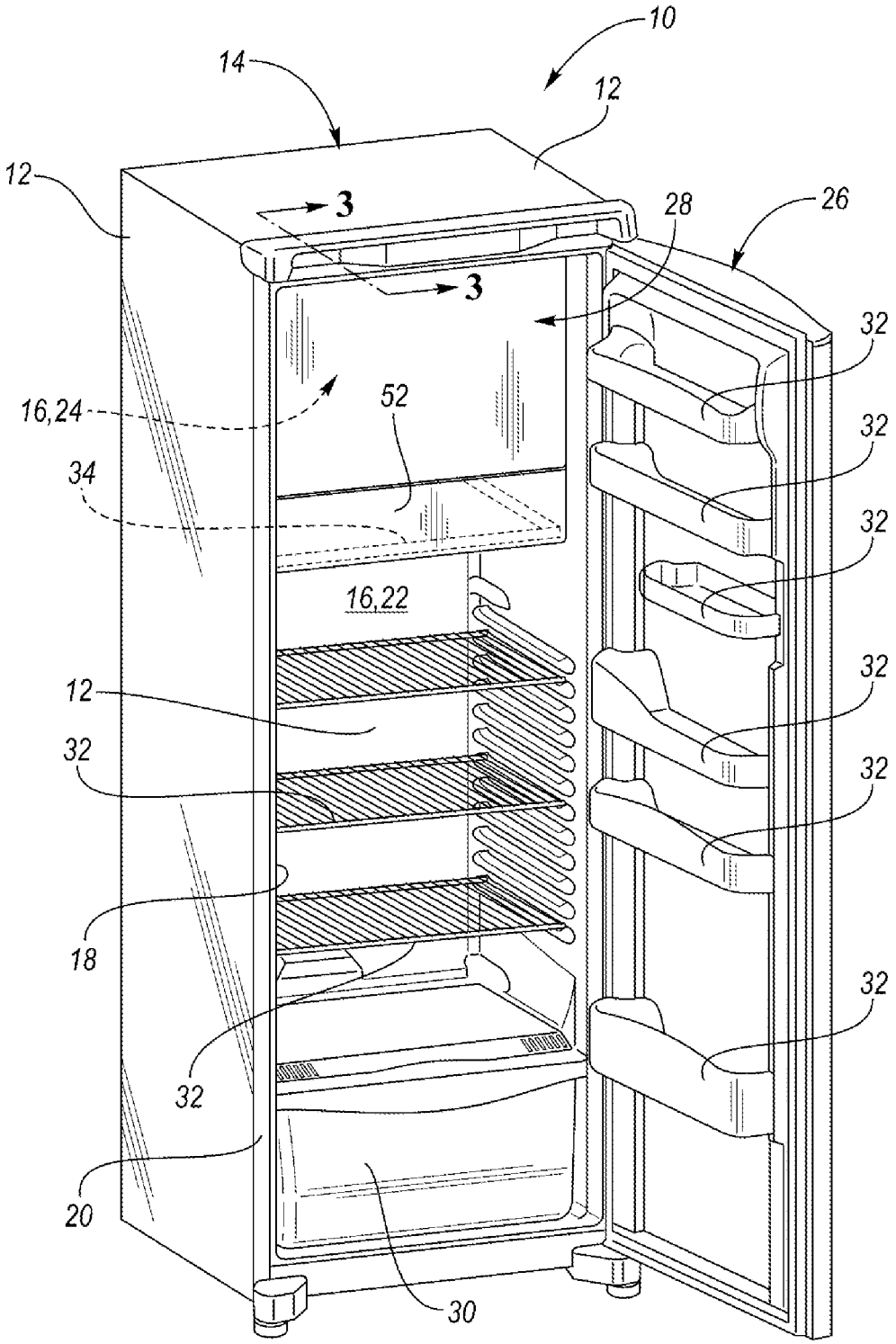
FIG. 1 is a front view of a refrigerator with the refrigerator door open.
Figure 2:
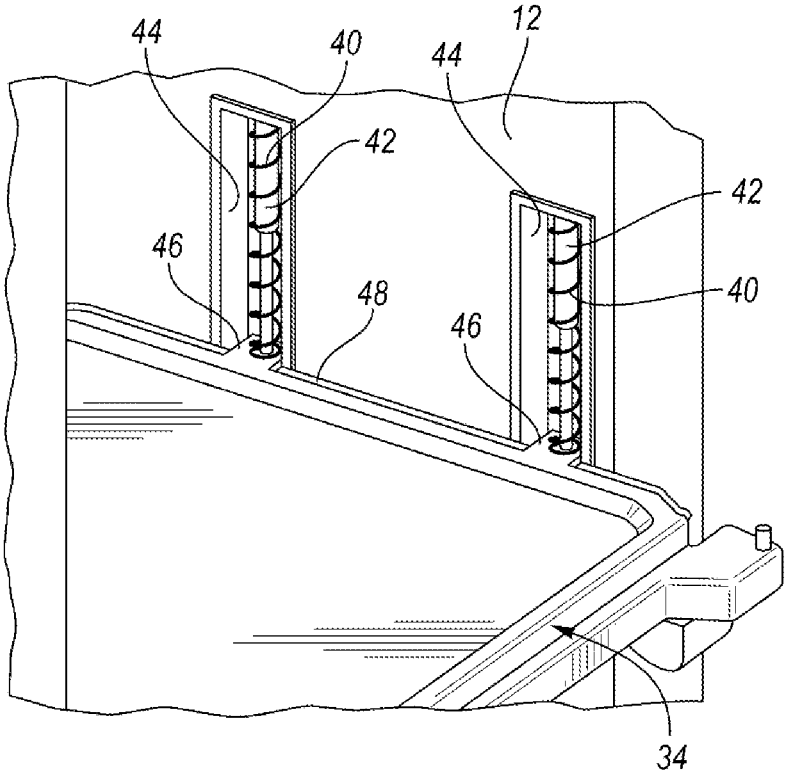
FIG. 2 is a partial isometric view of a mullion that divides the internal cavity of the refrigerator into a refrigerator compartment and a freezer compartment.
Figure 3:
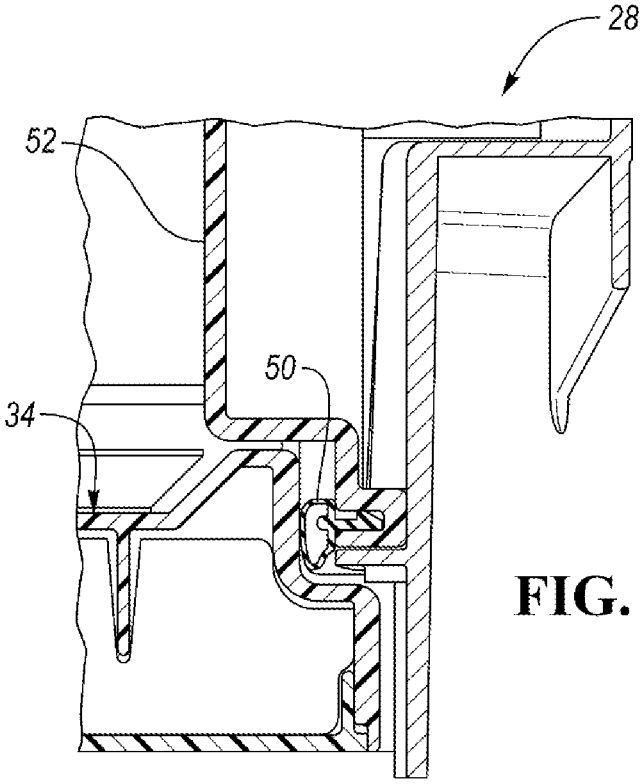
FIG. 3 is a partial cross-sectional view taken along line 3-3 of FIG. 1 illustrating the mullion and a freezer compartment door.
Figure 4:
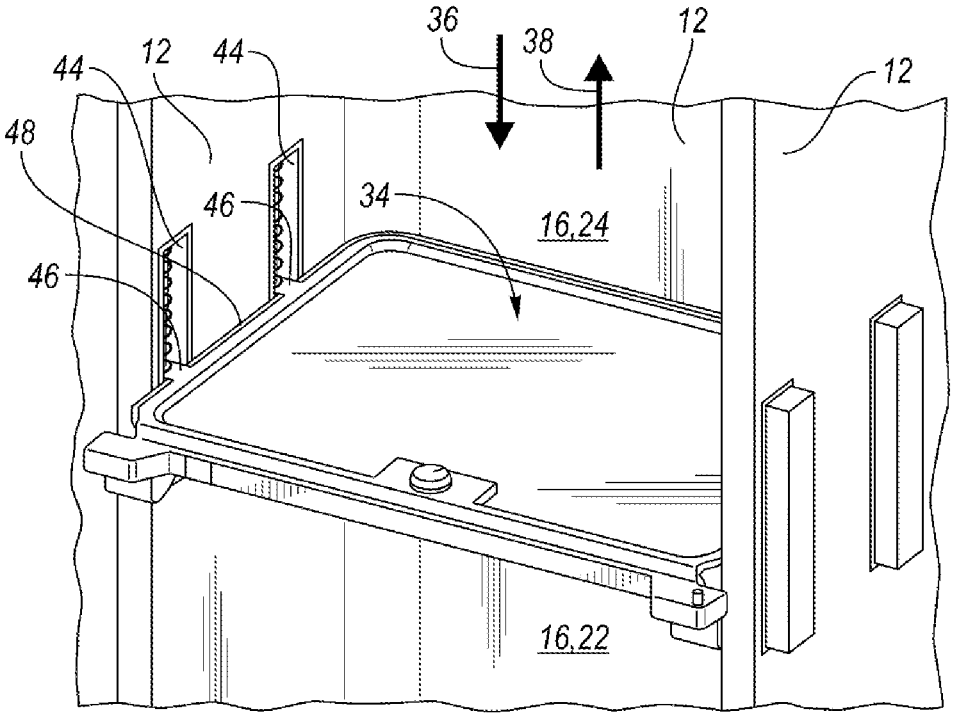
FIG. 4 is an isometric view of the mullion in a lower position.
Figure 5:
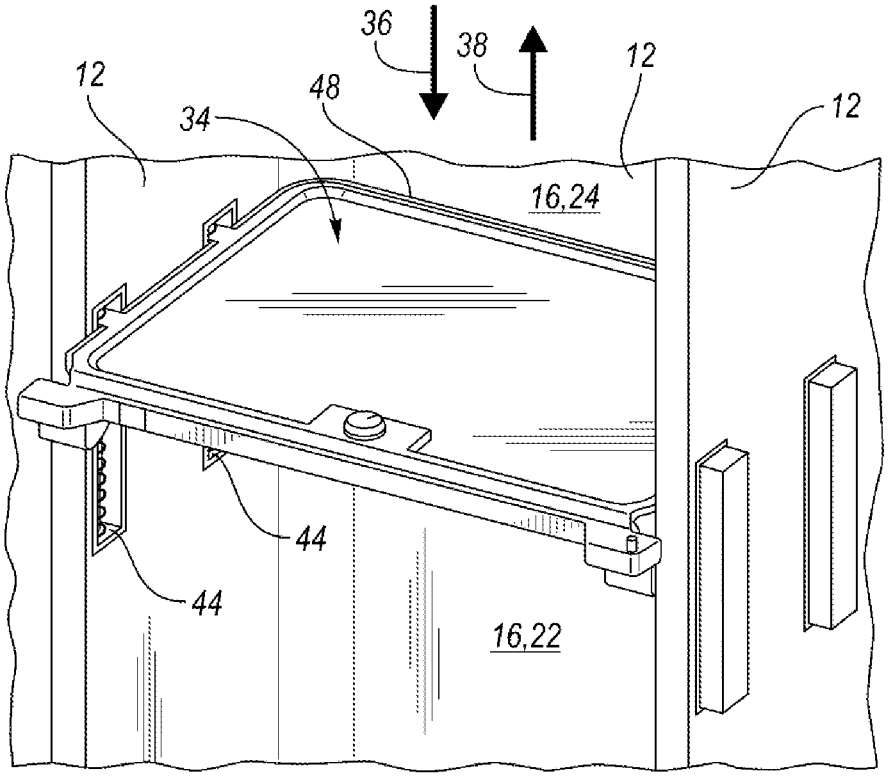
FIG. 5 is an isometric view of the mullion in an upper position.

Referring to FIG. 1, generally a refrigerator appliance 10 having a single door is illustrated. The refrigerator 10 has a plurality of walls 12 that form a housing 14. The walls 12 may include exterior panels and an internal liner. An insulating material, such as an insulating foam, may be disposed between the exterior panels and the internal liner of the walls 12 in order reduce the heat transfer from the ambient surroundings and increase the efficiency of the refrigerator. The walls 12 may include a rear or back wall, a top wall, a bottom wall, and two side walls. The plurality of walls 12 and the housing 14 define an internal cavity 16 and an opening 18 to the internal cavity 16. More specifically, a door frame 20 may define the opening 18 to access the internal cavity 16.

The internal cavity 16 may be divided into a first internal storage chamber or fresh food compartment 22 and a second internal storage chamber or freezer compartment 24. The first internal storage chamber, fresh food compartment, or refrigerator compartment 22 may be configured to refrigerate and not freeze consumables within the fresh food compartment 22. The second internal storage chamber or a freezer compartment 24 may be configured to freeze consumables within the freezer compartment 24 during normal use.

The single door 26 of refrigerator 10 provides access to the interior volume of the refrigerator 10 (i.e., the internal cavity 16) where consumables may be stored. The door 26 may be rotatably secured to the walls 12 by one or more hinges. A secondary door or freezer compartment door 28 may be disposed within the internal cavity 16 and over the freezer compartment 24 to provide a barrier between the freezer compartment 24 and the refrigerator compartment 22 within the internal cavity 16. A crisper 30 may be disposed within the refrigerator compartment 22. The crisper 30 may more specifically be a drawer defining a storage space that is kept at a desired humidity that may be different from the remainder of the refrigerator compartment 22, but that is optimal for maintaining freshness of fruits and vegetables. One or more shelves 32 may be secured to the walls 12 within the refrigerator compartment 22 and to an internal surface of the door 26.

It is generally known that the freezer compartment 24 is typically kept at a temperature below the freezing point of water, and the refrigerator compartment 22 is typically kept at a temperature above the freezing point of water and generally below a temperature of from about 35° F. to about 50° F., and more typically below about 38° F.

The door 26 may include an exterior panel and an interior panel that is disposed on an internal side of the exterior panel of the door 26. The interior panel may be configured to face the internal cavity 16 when the door 26 is in a closed position. The interior panel of the door 26 may more specifically be a door liner. An insulating material, such as an insulating foam, may be disposed between the exterior panel and interior panel of the door 26 in order reduce the heat transfer from the ambient surroundings and increase the efficiency of the refrigerator.

The refrigerator 10 includes one or more refrigeration loops (not shown) that are configured to cool the air the within the refrigerator compartment 22 and the freezer compartment 24. The refrigeration loop includes at least a compressor, an evaporator that cools air being delivered to the refrigerator compartment 22 and/or the freezer compartment 24, a condenser that rejects heat to ambient surroundings, and a thermal expansion valve. Fans may be utilized to direct air across the evaporator and the condenser to facilitate exchanging heat. The compressor and the fans may be connected to a controller. Sensors that measure the air temperature within the refrigerator compartment 22 and the freezer compartment 24 may be in communication with the controller. The controller may be configured to operate the compressor, fans, etc. in response to the air temperature within the within the refrigerator compartment 22 and the freezer compartment 24 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

Referring to FIGS. 2-5, a mullion 34 that separates the freezer compartment 24 from the refrigerator compartment 22 is illustrated. Generally, a mullion is a strip of material that divides an opening or space into two openings or spaces. Here, mullion 34 is disposed within the internal cavity 16 and separates the internal cavity 16 into the freezer compartment 24 and the refrigerator compartment 22. The mullion 34 may function as a lower shelf of the freezer compartment 24.

The mullion 34 is slidable relative to and along the walls 12 within the internal cavity 16 in a first direction 36 and in a second direction 38 that is opposite to the first direction. More specifically, the first direction 36 may be a downward direction and the second direction 38 may be an upward direction. Furthermore, movement of the mullion 34 in the first direction 36 may correspond to movement of the mullion 34 away from the freezer compartment 24 and toward the refrigerator compartment 22, while movement of the mullion 34 in the second direction 38 may correspond to movement of the mullion 34 away from the refrigerator compartment 22 and toward the freezer compartment 24. Adjusting the position of the mullion 34 in the first direction 36 increases a volume of the freezer compartment 24 and decreases a volume of the refrigerator compartment 22. Adjusting the position of the mullion 34 in the first direction 36 may correspond to lowering the position of the mullion 34. Adjusting the position of the mullion 34 in the second direction 38 increases the volume of the refrigerator compartment 22 and decreases the volume of the freezer compartment 34. Adjusting the position of the mullion 34 in the second direction 38 may correspond to raising the position of the mullion 34. The mullion 34 is illustrated in a bottom-most position in FIG. 4 and in an upper-most position in FIG. 5.

One or more biasing elements 40 may be secured to the mullion 34 and the walls 12. The biasing elements 40 may be configured to bias the mullion 34 in the second direction 38 (e.g., toward the freezer compartment 24) such that placement of items (e.g., food items) on the mullion 34 adjusts the position of the mullion 34 toward the first direction 36 (e.g., lowers the mullion 34) and such that removal of items from the mullion 34 adjusts the position of the shelf toward the second direction 38 (e.g., raises the mullion 34).

One or more dampeners 42 may be secured to the mullion 34 and the walls 12. The dampeners 42 may be pneumatic or hydraulic cylinders. The dampeners 42 may more specifically be configured to limit a velocity of the mullion 34 in the first direction 36 (e.g., in a direction toward the refrigerator compartment 22 and away from the freezer compartment 24). However, the dampeners 42 may also limit the velocity of the mullion 34 in the second direction 38 (e.g., in a direction toward the freezer compartment 24 and away from the refrigerator compartment 22). Each of the biasing elements 40 may comprise springs that are disposed the radially about one of the dampeners 42. More specifically, the biasing elements 40 may be tension springs. However, it should be understood the biasing elements could be compression springs that are positioned below as opposed to above the mullion 34 as illustrated.

The walls 12 may define slots 44. The biasing elements 40 and the dampeners 42 may be disposed within the slots 44. More specifically, one of the biasing elements 40 and one of the dampeners 42 may be disposed within each slot 44. The mullion 34 has protrusions 46 extending outward therefrom. Each protrusion 46 extends into one of the slots 44. The mullion 34 may be secured to the biasing elements 40 and the dampeners 42 via the protrusions. More specifically, each protrusion 46 may be secured to one of the biasing elements 40 and one of the dampeners 42 within one of the slots 44. The protrusions 46 may be positioned proximate to the four corners of the mullion 34 to provide balance to the mullion 34. The range of motion of the mullion 34 may be limited to upper and lower ends of the slots 44. More specifically, the protrusions 46 engaging a lower end of the slots 44 may correspond to an absolute lowest position of the mullion 34 and the protrusions 46 engaging an upper end of the slots 44 may correspond to an absolute upper position of the mullion 34.

A first seal 48 may be disposed about three of the four sides of the mullion 34. The first seal 48 may be configured to prevent air from flowing between the freezer compartment 24 and the refrigerator compartment 22 along the border between the walls 12 and the mullion 34. A second seal 50 may be disposed between the mullion 34 and the freezer door 28. The second seal 50 may be configured to prevent air from flowing between the freezer compartment 24 and the refrigerator compartment 22 along the border between the front edge of the mullion 34 and the freezer door 28. More specifically, the second seal 50 may be secured to a sliding portion 52 of the freezer door 28 that is configured to slide up and down along with mullion 34 in order to maintain engagement between the mullion 34 and the second seal 50. The sliding portion 52 of the freezer door 28 may be disposed and slidable within slots defined by a main portion of the freezer door 28. The first seal 48 and the second seal 50 may be made from any flexible material that has sealing characteristics, such as a soft plastic or rubber.

Figure 6:
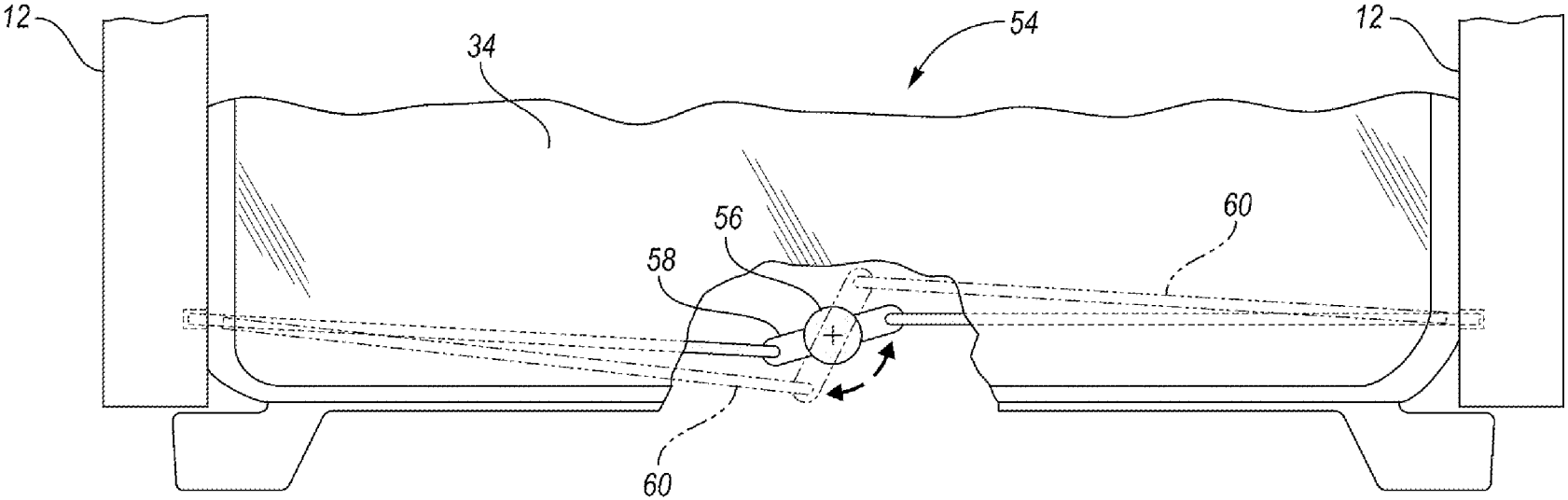
FIG. 6 is a partial isometric top view of the mullion illustrating a position locking mechanism for the mullion.

Referring now to FIG. 6, a lock 54 that is configured to secure the position of the mullion 34 is illustrated. The lock 54 may be able to secure the mullion in any desired position that is between the bottom-most position in FIG. 4 and the upper-most position in FIG. 5. The lock 54 may comprise a knob 56 that may transition between a locked position and an unlocked position (shown in phantom lines). A backside of the knob 56 may be connected to plate 58. Plate 58 in turn may be rotatably connected to locking arms 60. In the unlocked position, the locking arms 60 are receded into the mullion 34. In the locked position the locking arms 60 protrude from the mullion 34 and engage the walls 12 to lock position of the mullion 34 relative to the walls 12. The locking arms 60 may extend into orifices defined by the walls 12 as shown to lock position of the mullion 34 relative to the walls 12. Alternatively, the locking arms 60 may simply engage the outer surface of the walls 12 and the friction between the locking arms 60 and the outer surface of the walls 12 may lock position of the mullion 34 relative to the walls 12.

The refrigerator configuration descried herein, allows the mullion 34 to slide up and down within the internal cavity 16 to increase and decrease the size of the freezer compartment 24 based on the load placed on the mullion 34. A greater load on the mullion 34 is indicative that more items have been placed in the freezer compartment 24 and, therefore, more freezer space is desired. A lesser load on the mullion is indicative that the less items have been place in the freezer compartment 24 and, therefore, less freezer space is desired.

Since the freezer compartment 24 requires a lower temperature than the refrigerator compartment 22, more energy is required per unit of space to maintain the desired temperature of the freezer compartment 24 than the energy required per unit of space to maintain the desired temperature of the refrigerator compartment 22. The configuration described herein allows for an increase in efficiency of the refrigerator 10 by decreasing the space of the freezer compartment 24 when less items are placed within the freezer compartment 24. Furthermore, the configuration described herein does not require any action (e.g., selecting an efficiency mode on a control panel) on the part of the operator of the refrigerator 10 other than the placing of items in or the removing of items from the freezer compartment 24 in order to adjust the overall storage space of the freezer compartment 24.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a plurality of walls defining an internal cavity and an opening to the internal cavity;

a door rotatably secured to at least one of the walls and disposed over the opening;

a mullion (i) disposed within the cavity, (ii) vertically slidable along the walls within the cavity, and (iii) dividing the cavity into a freezer compartment and a refrigerator compartment, wherein lowering a position of the mullion increases a volume of the freezer compartment and decreases a volume of the refrigerator compartment, and raising the position of the mullion decreases the volume of the freezer compartment and increases the volume of the refrigerator compartment; and at least one biasing element secured to the mullion and at least one of the walls, wherein the at least one biasing element is configured to bias the mullion upward, and wherein placement of food items on the mullion lowers the position of the mullion and removal of food items from the mullion raises the position of the mullion.

2. The refrigerator appliance of claim 1, wherein at least one of the plurality of walls defines at least one slot, and wherein the at least one biasing element is disposed within the at least one slot.

3. The refrigerator appliance of claim 2 wherein the mullion includes at least one protrusion extending into the at least one slot, and wherein the mullion is secured to the at least one biasing element via the at least one protrusion.

4. The refrigerator appliance of claim 1 further comprising a lock that is configured to secure the position of the mullion.

5. The refrigerator appliance of claim 1 further comprising at least one dampener secured to the mullion and at least one of the walls, wherein the at least one dampener is configured to limit a downward velocity of the mullion.

6. The refrigerator appliance of claim 5, wherein at least one of the plurality of walls defines at least one slot, and wherein the at least one dampener is disposed within the at least one slot.

7. The refrigerator appliance of claim 5, wherein the at least one dampener is a pneumatic cylinder.

8. A refrigerator appliance comprising:

a housing defming a first compartment, a second compartment, and an opening, wherein the opening accesses both the first and second compartments;

a shelf (i) disposed within the housing, (ii) separating the first compartment from the second compartment, (iii) slidable relative to the housing such that movement of the shelf in a first direction increases a volume of the first compartment and decreases a volume of the second compartment, and such that movement of the shelf in a second direction decreases the volume of the first compartment and increases the volume of the second compartment; and a biasing element configured to bias the shelf toward the second direction, wherein placement of items on the shelf adjusts a position of the shelf toward the first direction and removal of items from the shelf adjusts the position of the shelf toward the second direction.

9. The refrigerator appliance of claim 8, wherein the first compartment is a freezer compartment and the second compartment is a refrigerator compartment.

10. The refrigerator appliance of claim 8, wherein the housing defines a slot, and wherein the biasing element is disposed within the slot.

11. The refrigerator appliance of claim 10, wherein the shelf has a protrusion extending into the slot, and wherein the shelf is secured to the biasing element via the protrusion.

12. The refrigerator appliance of claim 8 further comprising a lock that is configured to secure the position of the shelf.

13. The refrigerator appliance of claim 8 further comprising a dampener secured to the shelf, wherein the dampener is configured to limit a velocity of the shelf in the first direction.

14. The refrigerator appliance of claim 13, wherein the housing defines a slot, and wherein the dampener is disposed within the slot.

15. The refrigerator appliance of claim 13, wherein the dampener is a pneumatic cylinder.

16. A refrigerator appliance comprising:

a housing defining an internal cavity and a door frame that accesses the internal cavity;

a mullion disposed within the cavity and dividing the cavity into a freezer compartment and a refrigerator compartment, wherein a position of the mullion is adjustable within the cavity such that (i) movement of the mullion away from the freezer compartment and toward the refrigerator compartment increases a volume of the freezer compartment and decreases a volume of the refrigerator compartment and (ii) movement of the mullion away from the refrigerator compartment and toward the freezer the compartment decreases the volume of the freezer compartment and increases the volume of the refrigerator compartment; and a biasing element secured to the housing and the mullion, wherein the biasing element is configured to bias the mullion toward the freezer compartment.

17. The refrigerator appliance of claim 16 further comprising a dampener secured to the mullion, wherein the dampener is configured to limit a velocity of the mullion toward the refrigerator compartment.

18. The refrigerator appliance of claim 17, wherein the housing defines a slot, and wherein the biasing element and the dampener are disposed within the slot.

19. The refrigerator appliance of claim 18, wherein the mullion has a protrusion extending into the slot, and wherein the mullion is secured to the biasing element and the dampener via the protrusion.

20. The refrigerator appliance of claim 17, wherein the biasing element is a spring that is positioned radially about the dampener.

* * * * *